US006059601A

United States Patent [19]

Hirai et al.

[11] Patent Number: 6,059,601

[45] Date of Patent: May 9, 2000

[54] SINGLE-SIDED PRESS-PINCHING CONNECTOR AND A METHOD OF MAKING SAME

[75] Inventors: Yuji Hirai; Yoshikazu Katoh, both of Tokyo, Japan

[73] Assignee: Honda Tsushin Kogyo Co., Tokyo, Japan

[21] Appl. No.: 08/937,079

[22] Filed: Sep. 24, 1997

[30] Foreign Application Priority Data

Feb. 10, 1997 [JP] Japan ..... 9-026387

[51] Int. Cl.[7] ..... H01R 4/24

[52] U.S. Cl. ..... 439/405; 29/874; 29/876; 29/883

[58] Field of Search ..... 439/347, 348, 439/399, 607, 391–405; 29/838, 829–832, 834–835, 854–857, 873, 874, 882, 884, 885, 883, 876

[56] References Cited

U.S. PATENT DOCUMENTS

| | | | |
|---|---|---|---|
| 3,824,530 | 7/1974 | Roberts et al. | 439/398 |
| 4,040,704 | 8/1977 | Huber | 439/400 |
| 4,190,952 | 3/1980 | Thomas et al. | 29/845 |
| 5,603,634 | 2/1997 | Ichikawa et al. | 439/404 |
| 5,766,033 | 6/1998 | Davis | 439/405 |
| 5,794,332 | 8/1998 | Yamamoto et al. | 29/863 |

*Primary Examiner*—Michael L. Gellner
*Assistant Examiner*—Barry M. L. Standig
*Attorney, Agent, or Firm*—Arnet Fox Kintner Plotkin & Kahn

[57] ABSTRACT

In order to provide a single-sided, conductor-pinching connector suitable for connecting numerous conductors while reducing occupation space, it comprises an insulating body having a flat male projection extending on its mating side, contact pieces whose contact stems are laid on the opposite surfaces of the flat male projection of the insulating body, a shell enclosing the mating side of the insulating body, and a press plate to press the stripped ends of the insulated conductors against the conductor-pinching rear ends of the contact pieces. The conductor-pinching rear ends are bent at right angle relative to the contact stems of the contact pieces, and are directed in one and same direction. The arranging of upright conductor-pinching ends in one and same direction rather than the opposite directions permits reduction of the connector thickness to possible minimum.

1 Claim, 6 Drawing Sheets

SINGLE-SIDED PRESS-PINCHING CONNECTOR AND A METHOD OF MAKING SAME

BACKGROUND OF THE INVENTION

1. Field of the Invention

The present invention relates to a cable connector, and more particularly to a press-pinching connector structure which requires a reduced occupation space for connecting numerous conductors and a method of making such a cable connector.

2. Description of Related Art

Referring to FIG. 17, a press-pinching cable connector 20 comprises an insulating body 21 of synthetic resin, contact pieces 22 and 23, and a metal shell 20*a*. Specifically the insulating body 21 has a flat male projection 21*a* extending forward on its mating side, and the contact stems 22*a* and 23*a* of the contact pieces 22 and 23 (for example, 34 pins×2) are parallel-arranged at regular intervals on the opposite surfaces of the flat male projection 21*a* of the insulating body 21, and the conductor-pinching bifurcate tails 22*b* and 23*b* are laid on the rear end of the insulating body 21. The metal shell 20*a* encloses the flat male projection 21*a* to define a space for accommodating the mating end of an associated receptacle (not shown).

As seen from the drawing, the conductor-pinching bifurcate tails 22*b* and 23*b* of the contact pieces 22 and 23 are bent at right angle with respect to the straight stems 22*a* and 23*a* of the contact pieces 22 and 23, and the pinching bifurcate tails 22*b* and 23*b* are arranged outward in opposite directions. The conductors of a cable can be connected to the contact pieces 22 and 23 by pushing and holding each conductor end in the bifurcate tails 22*b* or 23*b* of each contact piece 22 or 23 with associated press plates 24 and 25.

The contact pieces 22 and 23 are arranged with their pinching bifurcate tails 22*b* and 23*b* directed outward in opposite directions. The fixing of the conductors of a cable on the opposite sides of the rear end of the insulating body 12 will increase the thickness of the cable connector, and the applying of the cover plates "b" to the opposite sides of the conductor-pinching area will add the thickness of the cover plate to the cable connector.

Referring to FIG. 19, two plug connectors 26 and 27 are laid on each other, and the so combined plug connectors 26 and 27 are mated with the receptacle connectors 28 and 29 both fixed to the casing of a printed circuit board. As seen from FIG. 20, the plug connectors 26 and 27 must adjoin each other with their alignment center axes "d" and "d" separated a relatively long distance "L" lest the plug connectors 26 and 27 should interfere with each other, and accordingly the adjoining receptacle connectors 28 and 29 must be separated from each other.

The increased thickness of the cable connector is attributable to: the contact pieces 22 and 23 have conductor-pinching bifurcate tails 22*b* and 23*b* directed outward in opposite directions. Additionally the cover plates are applied to the opposite sides of the conductor-pinching area of the cable connector. Disadvantageously the so increased thickness of the cable connector reduces the degree of freedom with which personal computers or electric or electronic apparatuses using function-expanding PC cards can be designed in reducing in size.

SUMMARY OF THE INVENTION

One object of the present invention is to provide a conductor-pinching type of cable connector of possible minimum thickness.

Another object of the present invention is to provide a method of making such a conductor-pinching type of cable connector of possible minimum thickness.

To attain these objects a single-sided, conductor-pinching connector comprising an insulating body having a flat male projection extending on its mating side, a plurality of contact pieces whose contact stems are laid on the opposite surfaces of the flat male projection of the insulating body, a shell enclosing the mating side of the insulating body, and a press plate to press the stripped ends of the insulated conductors against the conductor-pinching rear ends of the contact pieces, is improved according to the present invention in that the conductor-pinching rear ends are bent at right angle relative to the contact stems of the contact pieces, and are directed in one and same direction.

The conductor-pinching, "L"-shaped tails of the contact pieces arranged upright in one and same direction permit substantial reduction of the thickness of the connector, and accordingly multistage arrangement of cable connectors requires a reduced space, thus substantially increasing the conductor density per unit thickness.

The contact pieces may be insert-molded in the insulating body.

A method of making a single-sided, conductor-pinching connector according to the present invention comprises the steps of: preparing a plurality of conductor-pinching type of contact pieces having relatively long and short contact stems integrally connected to a carrier strip; preparing a primary insulating body component; putting the plurality of conductor-pinching type of contact pieces on the primary insulating body component with their relatively long and short contact stems laid on its opposite surfaces, and with their conductor-pinching, rear ends directed perpendicular to their contact stems in one and same direction; forming a secondary insulating body component by insert-molding the contact pieces thus put on the primary insulating body component; cutting and removing the carrier strip from the contact pieces; and applying press plates to the conductor-pinching rear ends of the contact pieces.

The insert-molding is effective to provide a contact looseless integral assembly.

Other objects and advantages of the present invention will be understood from the following description of a single-sided, conductor-pinching connector according to one preferred embodiment of the present invention, which is shown in accompanying drawings.

DESCRIPTION OF THE PREFERRED EMBODIMENTS

Figure 1:
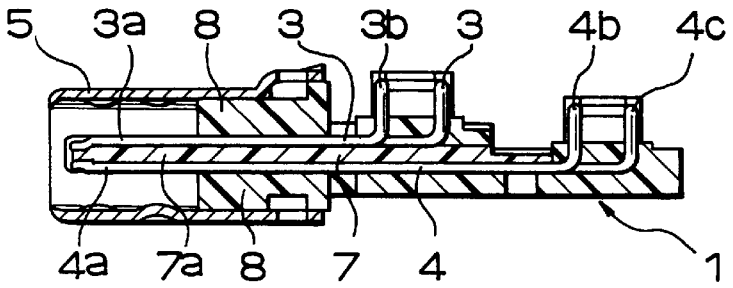
FIG. 1 is a longitudinal section of a single-sided, conductor-pinching connector assembly according to the present invention.

Referring to accompanying drawings a single-sided, press-pinching connector and a method of making the same are described. Referring to FIG. 1, a single-sided, press-pinching connector 1 comprises an insulating body of a synthetic resin 2 (7 and 8), contact pieces 3 and 4, a shell 5 and press plate or strips 6. The insulating body 2 is composed of a primary insulating body component 7 in the form of thin flat plate and a secondary insulating body component 8 integrally connected to the thin flat plate 7. The head of the flat plate 7 extending forward from the secondary insulating body component 8 is used as plug extension 7*a* to be mated with the female connector whereas the tail of the flat plate 7 extending rearward is used as conductor pinching area.

The contact pieces 3 and 4 have elongated contact stems 3*a* and 4*a* parallel-arranged and laid on the opposite surfaces of the flat male projection 7*a*.

Figure 2:
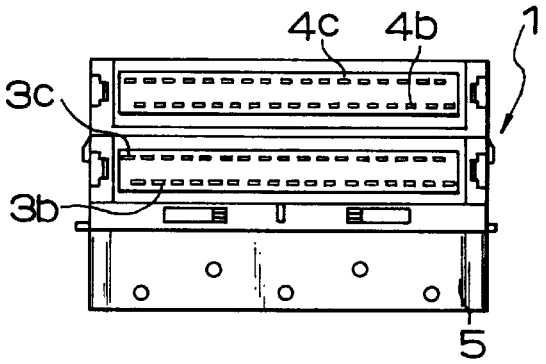
FIG. 2 is a plane view of the single-sided, conductor-pinching connector assembly.
Figure 3:
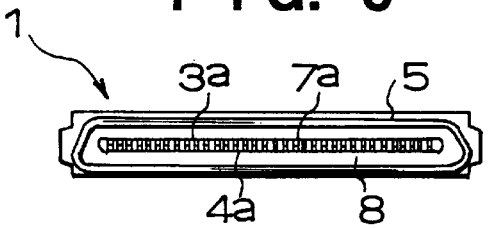
FIG. 3 is a front view of the single-sided, conductor-pinching connector assembly.
Figure 4:
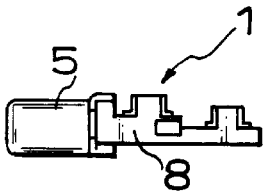
FIG. 4 is a side view of the single-sided, conductor-pinching connector assembly.

As seen from FIG. 1, the bifurcate, conductor-pinching rear ends 3*b*, 3*c* and 4*b*, 4*c* are bent at right angle relative to the elongated contact stems 3*a* and 4*a*, and are directed in one and same direction (upward in FIG. 1). As seen from FIG. 2, the contact pieces 3 and 4 are so parallel-arranged that their conductor-pinching rear ends 3*b*, 3*c* and 4*b*, 4*c* may be staggered in the conductor pinching area. The bifurcate ends 3*b* and 4*b* are aligned in line in directions perpendicular to the lateral arrangement of the bifurcate ends, in which directions conductors of the cable extend when press-pinched in the bifurcate ends 3*b* and 4*b*. Likewise, the bifurcate ends 3*c* and 4*c* are aligned in line in perpendicular directions.

The shell 5 provides an enclosure on the mating side of the cable connector, thus leaving an elongated annular space around the flat male projection 7*a* for mating with the counter connector. Each press strip 6 is composed of a flat plate of synthetic resin, which has perforations formed in conformity with the bifurcate tail pattern in the conductor pinching area. The stripped conductor ends are put in the bifurcate ends 3*b*, 3*c* and 4*b*, 4*c* of contact pieces 3 and 4, and then, the press strips 6 is pushed against the conductor ends for press-pinching, thus connecting each bundle of wires "a" of the cable A. The cable connector 9 can be attached to the housing of an electric or electronic apparatus or to a circuit board by driving associated bolts 10 into the tapped holes of the electric or electronic apparatus or the circuit board.

Figure 6:
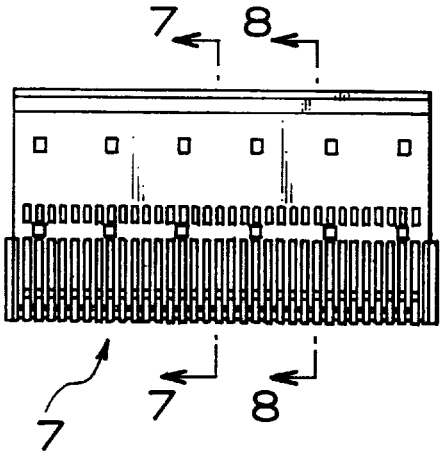
FIG. 6 is a plane view of a primary insulating body component to be incorporated in the single-sided, conductor-pinching connector assembly.
Figure 7:
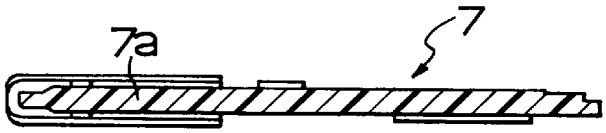
FIG. 7 is a longitudinal section of the primary insulating body component taken along the line 7—7 in FIG.6.
Figure 8:
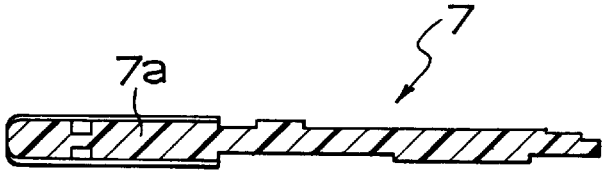
FIG. 8 is a similar longitudinal section of the primary insulating body component taken along the line 8—8 in FIG.6.
Figure 9:
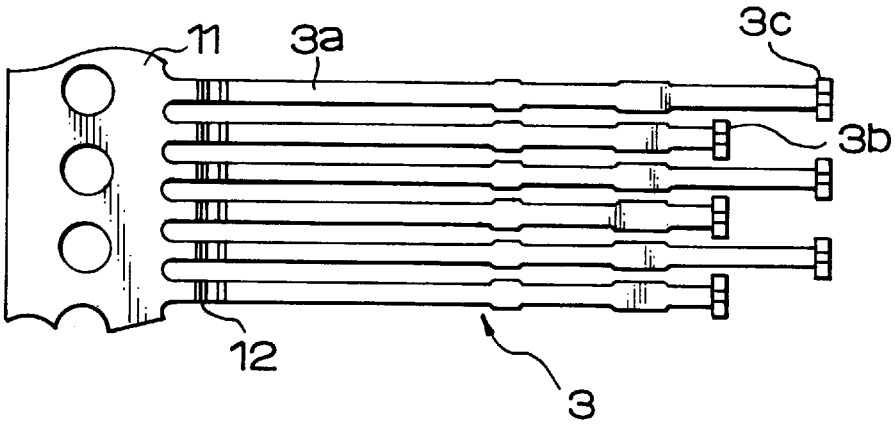
FIG. 9 is a plane view of a fragment of the stamped sheet of contact pieces.
Figure 10:
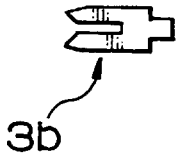
FIG. 10 is a front view of the conductor-pinching bifurcate tail of a contact piece.
Figure 11A:
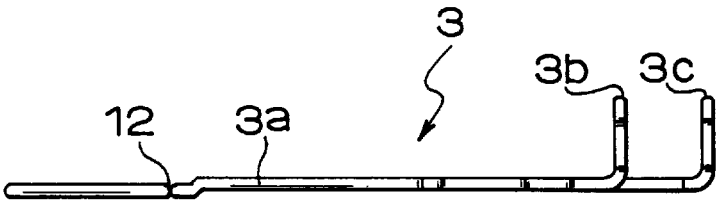
FIG. 11*a* is a side view of relatively short and long contact pieces parallel-arranged in a first group.
Figure 11B:
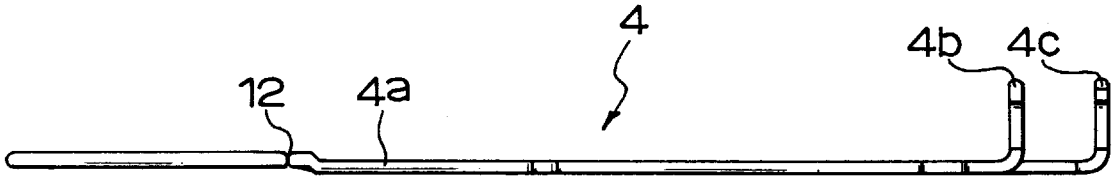
FIG. 11*b* is a side view of relatively short and long contact pieces parallel-arranged in a second group.

Now, the method of making such a cable connector is described. Referring to FIGS. 6 to 8, a primary insulating body component 7 of synthetic resin is prepared. Referring to FIGS. 9 and 10, a sheet of metal is stamped out to provide a parallel-arrangement of contacts 3 integrally connected to a carrier strip 11. Each contact 3 is composed of an elongated stem 3*a* ending with an upright, bifurcate conductor-pinching tail 3*b* or 3*c*. As seen from FIGS. 11*a* and 11*b*, contact pieces 3 and 4 have elongated contact stems 3*a* and 4*a* of different lengths and upright tails 3*b*, 3*c* and 4*b*, 4*c* directed in one and same directions. These contact pieces can be cut along the line 12 to be separated from the carrier strip 11.

Figure 12:
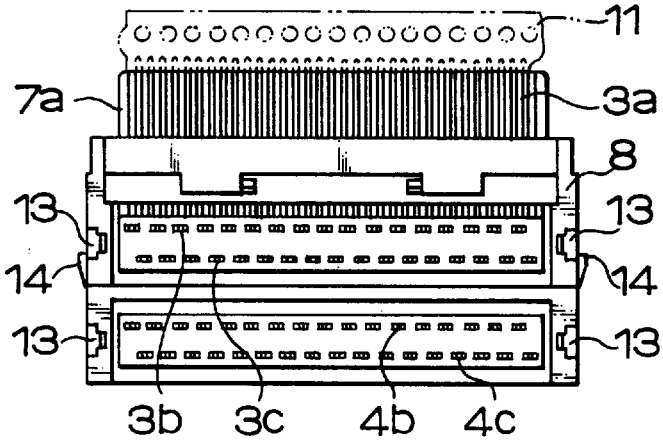
FIG. 12 shows, in plane, how a primary insulating body component having contacts of the first and second groups fixed thereto is insert-molded to form a connector assembly.
Figure 13:
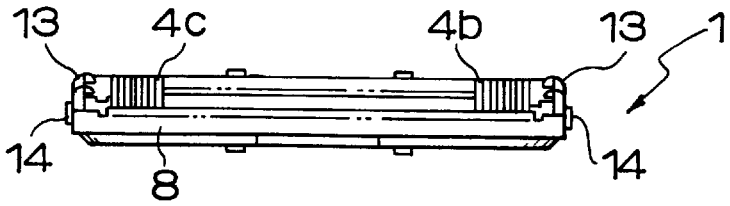
FIG. 13 is a front view of the connector assembly.
Figure 14:
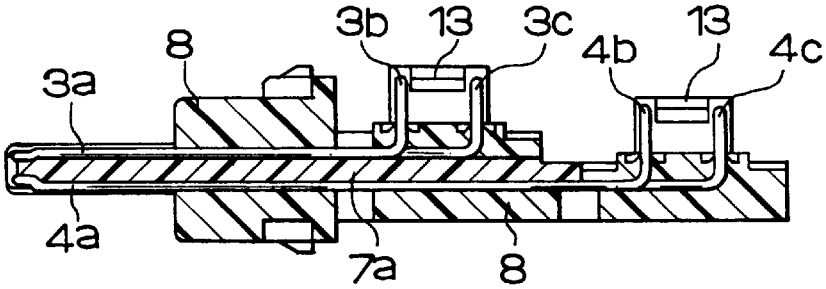
FIG. 14 is a longitudinal section of the single-sided crimping connector assembly.

Referring to FIGS. 12 to 14, a parallel-arrangement of contact pieces 3 and 4 are put on the plug extension 7*a* of the primary insulating body component 7, and then a secondary insulating body component 8 is integrally connected to the primary insulating body component 7 by insert-molding, thus embedding the contact pieces 3 and 4 in the area in which the primary and secondary insulating body components 7 and 8 are integrally connected. Thanks to the insert molding the contacts 3 and 4 are positively fixed to the insulating body.

The secondary insulating body component 8 has four upright engagement pieces 13 and two side engagement projections 14 on its opposite sides to catch the opposite ends each of the press strips 6 and the opposite sides of the cover "b" respectively.

The carrier strip 11 is cut and removed from the connector assembly, and finally the shell 5 is applied to the head of the connector assembly. Thus, the cable connector 1 results as shown in FIG. 1.

Figure 5:
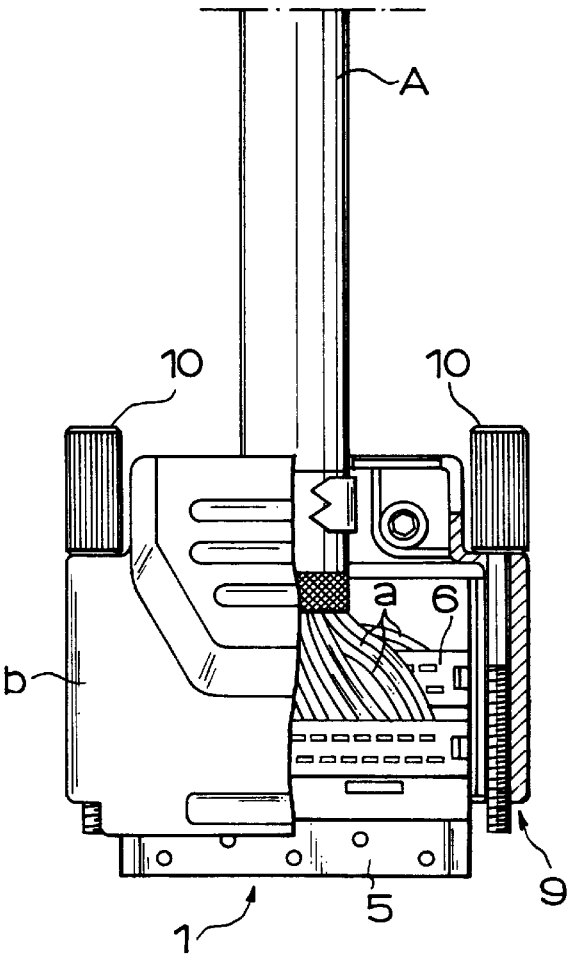
FIG. 5 is a plane view of the single-sided, conductor-pinching connector having cable conductors pinched and cover plates applied to its opposite sides, one cover plate partly broken to expose the inside.
Figure 15:
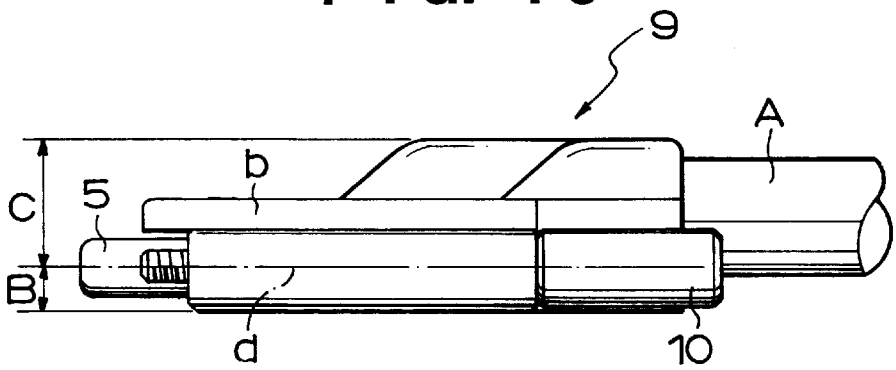
FIG. 15 is a side view of a single-sided, conductor-pinching connector having an electric cable connected thereto.

After the stripped ends of cable wires "a" are press-pinched in the tails 3*b*, 3*c* and 4*b*, 4*c* of the contact pieces 3 and 4, the cover "b" is applied to the cable connector 1 on its front or conductor-pinching side (see FIGS. 5 and 15).

Referring to FIG. 15, the thickness "C" of the single-sided, press-pinching connector 9 is measured on the conductor-pinching side relative to the center line "d" of insertion along which the plug connector 9 is inserted in the receptacle connector, and the thickness "B" of the plug connector 9 is measured in the opposite direction relative to the center line "d" of insertion. As seen from the drawing, the thickness "B" on the rear side is substantially reduced compared with the thickness "C" on the front or conductor-pinching side.

Figure 16:
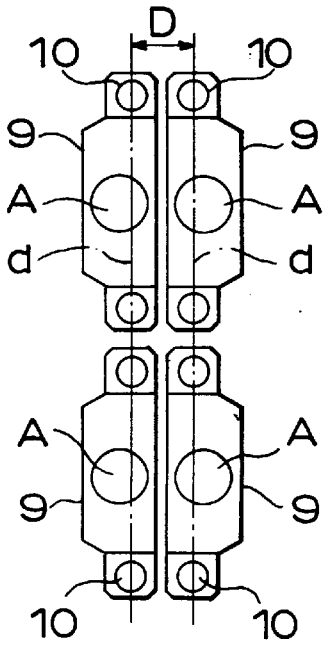
FIG. 16 shows how cable connectors are arranged and combined in use.
Figure 17:
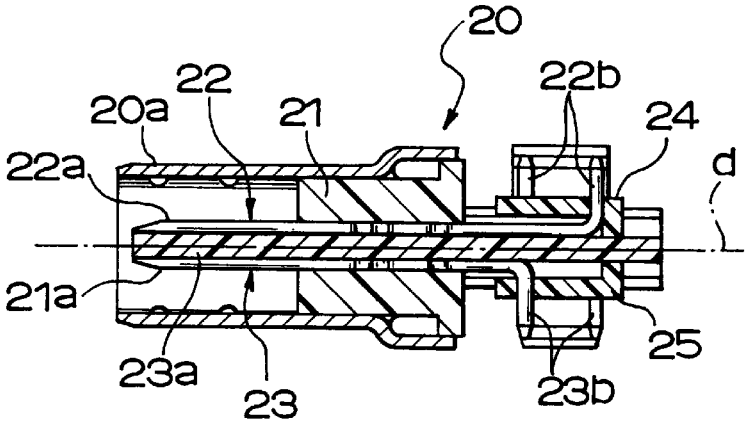
FIG. 17 PRIOR ART
FIG. 17 is a longitudinal section of a conventional conductor-pinching connector.
Figure 18:
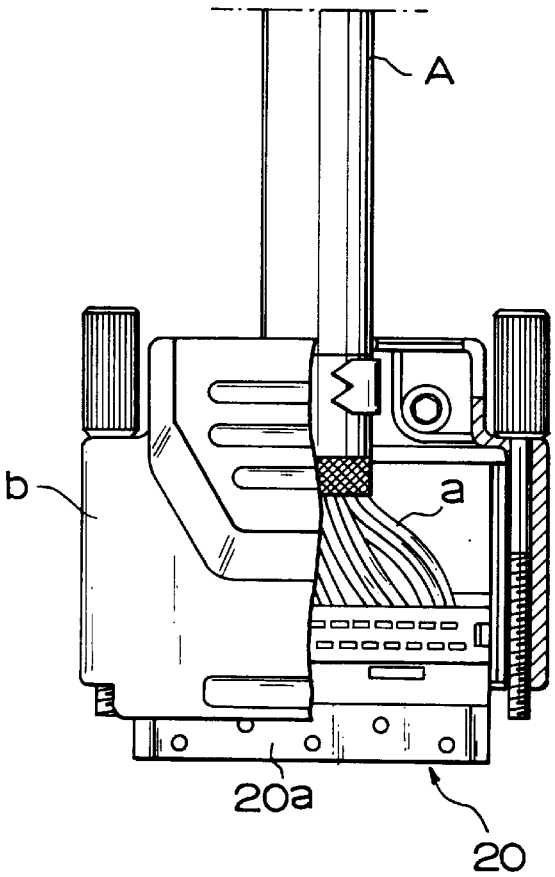
FIG. 18 PRIOR ART
FIG. 18 is a plane view of the conventional conductor-pinching connector having cable conductors pinched and cover plates applied to its opposite sides, one cover plate partly broken to expose the inside.
Figure 19:
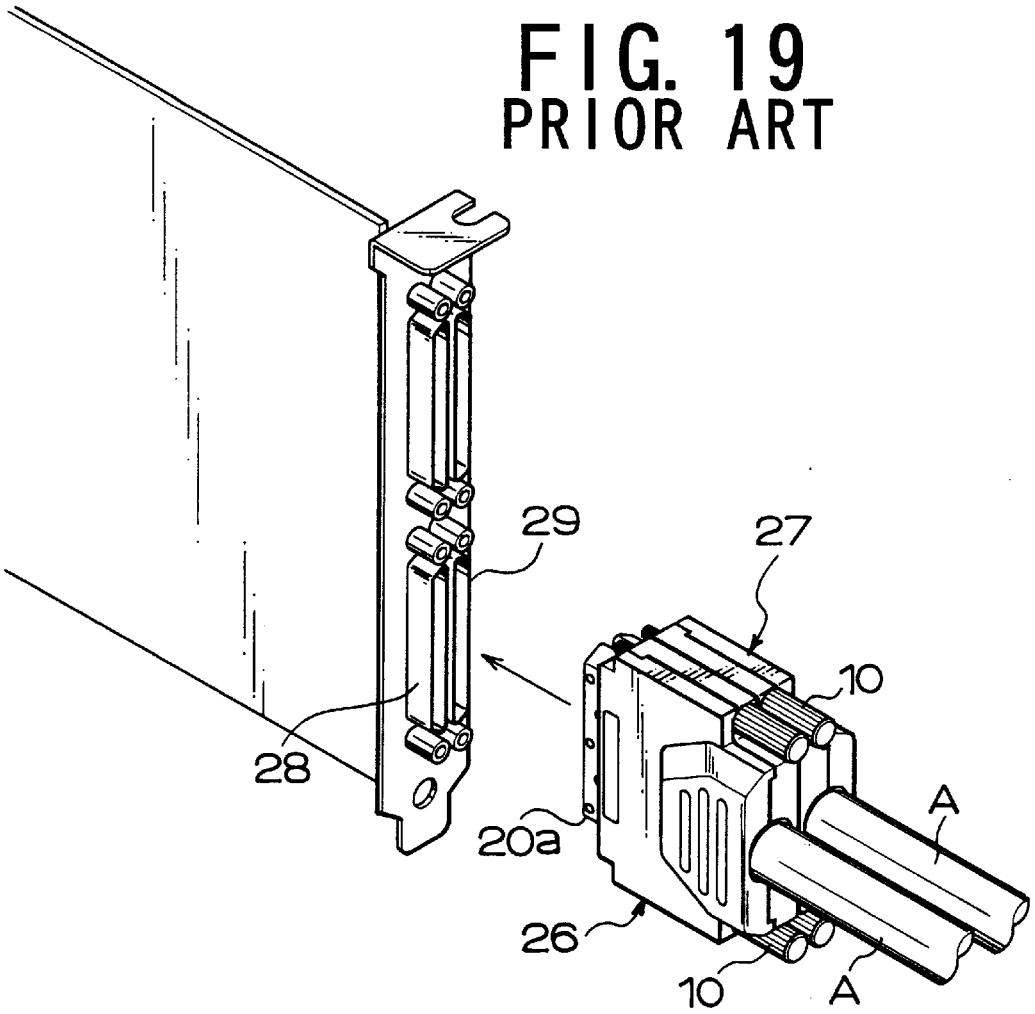
FIG. 19 PRIOR ART
FIG. 19 is a perspective view of conventional cable connectors, showing how the adjoining cable connectors are mated with the counter connectors.
Figure 20:
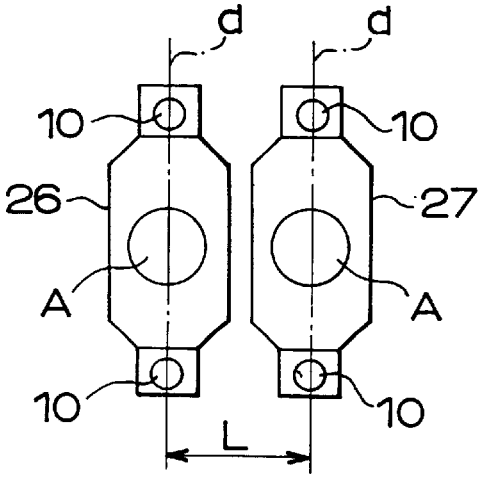
FIG. 20 PRIOR ART
FIG. 20 shows adjoining cable connectors in use.

Referring to FIG. 16, single-sided, press-pinching connectors 9 are combined with their front or conductor-pinching sides outward in use. As seen from the drawing, the distance "D" between the center lines "d" of insertion is substantially reduced, compared with the distance "L"

between the center lines "d" of insertion in the adjoining conventional cable connectors as shown in FIG. 20. The close arrangement of adjoining plug connectors permits the corresponding close arrangement of receptacle connectors (see FIG. 19), and accordingly the mounting of cables "A" to an electric or electronic apparatus require a substantially reduced occupation space, compared with the occupation space required by the conventional cable connectors in connecting same number of cables to the electric or electronic apparatus. Stated otherwise, an increased number of cables "A" can be connected to an electric or electronic apparatus in same space.

What is claimed is:

1. A method of making a single-sided, conductor-pinching connector comprising steps of:

preparing a plurality of conductor-pinching contact pieces having long and short contact stems integrally connected to a carrier strip and conductor-pinching rear ends;

preparing a primary insulating body component;

putting the plurality of conductor-pinching contact pieces on the primary insulating body component with said long and short contact stems laid on opposite surfaces thereof, and with the conductor-pinching, rear ends directed perpendicular to the contact stems such that the conductor-pinching rear ends are all directed in the same direction;

forming a secondary insulating body component by insert-molding the contact pieces thus put on the primary insulating body component;

cutting and removing the carrier strip from the contact pieces; and applying press plates to the conductor-pinching rear ends of the contact pieces.

* * * * *